US011599064B2

(12) United States Patent
Di Domenico et al.

(10) Patent No.: US 11,599,064 B2
(45) Date of Patent: Mar. 7, 2023

(54) INERTIA MOBILE COMPONENT FOR HOROLOGICAL RESONATOR WITH MAGNETIC INTERACTION DEVICE INSENSITIVE TO THE EXTERNAL MAGNETIC FIELD

(71) Applicant: The Swatch Group Research and Development Ltd, Marin (CH)

(72) Inventors: Gianni Di Domenico, Neuchâtel (CH); Jérôme Favre, Neuchâtel (CH); Olivier Matthey, Mauborget (CH); Dominique Lechot, Les Reussilles (CH); Baptiste Hinaux, Lausanne (CH); Laurent Nagy, Liebefeld (CH); Jean-Claude Martin, Montmollin (CH)

(73) Assignee: The Swatch Group Research and Development Ltd, Marin (CH)

( * ) Notice: Subject to any disclaimer, the term of this patent is extended or adjusted under 35 U.S.C. 154(b) by 346 days.

(21) Appl. No.: 16/896,613

(22) Filed: Jun. 9, 2020

(65) Prior Publication Data

US 2020/0409311 A1 Dec. 31, 2020

(30) Foreign Application Priority Data

Jun. 26, 2019 (EP) ..... 19182712

(51) Int. Cl.

| | |
|---|---|
| ***G04C 5/00*** | (2006.01) |
| ***G04B 15/14*** | (2006.01) |
| ***G04B 17/06*** | (2006.01) |
| ***G04B 17/32*** | (2006.01) |

(52) U.S. Cl.

CPC ..... *G04C 5/005* (2013.01); *G04B 15/14* (2013.01); *G04B 17/06* (2013.01); *G04B 17/32* (2013.01)

(58) Field of Classification Search

CPC ..... G04C 5/005; G04B 15/14; G04B 17/06; G04B 17/32

See application file for complete search history.

(56) References Cited

FOREIGN PATENT DOCUMENTS

| | | |
|---|---|---|
| EP | 2 990 885 B1 | 7/2017 |
| EP | 2 891 930 B1 | 9/2018 |
| EP | 3 273 309 B1 | 11/2018 |

OTHER PUBLICATIONS

European search report for EP 19 18 2712 dated Dec. 19, 2019.

*Primary Examiner* — Edwin A. Leon
*Assistant Examiner* — Kevin Andrew Johnston
(74) *Attorney, Agent, or Firm* — Sughrue Mion, PLLC

(57) ABSTRACT

Horological resonator (100) including an inertia mobile component (1) oscillating about an axis of oscillation (D1) and including at least one magnetic area (10), the total resultant magnetic moment of all of the magnetic areas (10), included in the inertia mobile component (1), is aligned in the direction of the axis of oscillation (D1), this inertia mobile component (1) bearing at least one balancing magnet (6), the direction of the magnetic moment thereof crosses the axis of oscillation (D1) to obtain magnetic balancing of the inertia mobile component (1).

24 Claims, 5 Drawing Sheets

INERTIA MOBILE COMPONENT FOR HOROLOGICAL RESONATOR WITH MAGNETIC INTERACTION DEVICE INSENSITIVE TO THE EXTERNAL MAGNETIC FIELD

CROSS-REFERENCE TO RELATED APPLICATION

This application claims priority to European Patent Application No. 19182712.0, filed on Jun. 26, 2019, the entire contents of which are incorporated herein by reference.

FIELD OF THE INVENTION

The invention relates to a horological resonator comprising at least one inertia mobile component for a horological resonator, arranged so as to oscillate about an axis of oscillation and comprising at least one magnetic area, which magnetic area comprises at least one magnet or at least one magnetised ferromagnetic area, and comprising return means for maintaining the oscillation of the at least one inertia mobile component.

The invention further relates to a horological movement comprising powering and/or energy storage means arranged so as to power at least one such resonator, comprised in the movement, and an escapement mechanism comprising at least one escape wheel set arranged so as to engage, with interaction, with the at least one inertia mobile component of the resonator.

The invention further relates to a timepiece, in particular a watch, comprising at least one such movement.

The invention relates to the field of horological mechanisms, and more specifically horological resonators, of the magnetic type, or at least one part of the running thereof is based on magnetic attraction and/or repulsion, and in particular comprising magnets.

BACKGROUND OF THE INVENTION

Certain mechanical resonators used in horology bear magnets.

Examples include the Clifford-type mechanisms, known from the documents FR1113932, FR2132162 and U.S. Pat. No. 2,946,183, or the direct synchronisation resonators of the SWATCH GROUP, known from the documents EP2887156 and EP3316046. In these oscillators, the use of magnets on the resonator allows for direct synchronisation, without frictional contact, between the resonator and the escape wheel. The absence of any pallet-lever between the escape wheel and the resonator, in addition to the absence of frictional contact, procure the advantage of high efficiency.

However, the magnets carried by the balance can be affected by the presence of external magnetic fields. The perturbation resulting therefrom, although low, can result in a variation of daily rate.

The document EP3273309A1 filed by Montres Breguet discloses a horological oscillator comprising a sprung balance assembly comprising a balance with a felloe, which is returned by a balance spring, pivoted with respect to a structure, on a first side by a torsion wire, fixed by an anchoring element to the structure, and on a second side, opposite to the first side, by a contactless magnetic pivot, the balance comprising a first pole embedded with the balance and the torsion wire, this first pole having a symmetry with respect to the axis of the sprung balance assembly, and cooperating with a second pole comprised in the structure, for the magnetic suspension of the first pole, and to exert on the distal end of the torsion wire, opposite to this anchoring element, a magnetic force for tensioning the torsion wire.

Document EP2891930A2 filed by The Swatch Group Research & Development Ltd discloses a device for regulating the relative angular speed between a magnetic structure and a resonator magnetically coupled to each other and forming an oscillator which defines a magnetic escapement. The magnetic structure includes at least one annular path formed of a magnetic material of which one physical parameter is correlated to the magnetic potential energy of the oscillator, the magnetic material being arranged along the annular path so that this physical parameter varies angularly in a periodic manner. The annular path includes, in each angular period, an area of accumulation of magnetic potential energy in the oscillator, radially adjacent to an impulse area. The magnetic material, in each accumulation area, is arranged so that the physical parameter of this magnetic material gradually increases angularly or gradually decreases angularly.

Document EP3299907A1 filed by ETA Manufacture Horlogere Suisse discloses a mechanical horological movement comprising a resonator, an escapement linked to the resonator and a display of at least one piece of temporal information. The display is driven by a mechanical drive device via a counter gear train, the working rate thereof is set by the escapement. At least the resonator is housed in a chamber which is subjected to a pressure that is below atmospheric pressure. The escapement is a magnetic escapement comprising an escape wheel directly or indirectly coupled to the resonator via a contactless magnetic coupling system, wherein the magnetic coupling system is formed such that a non-magnetic wall of the chamber passes through the magnetic escapement such that a first part of the escapement is located inside the chamber whereas a second part of the escapement is located outside the chamber.

SUMMARY OF THE INVENTION

The purpose of the present invention is to make such resonators insensitive to external magnetic fields.

For this purpose, the invention relates to a resonator inertia mobile component according to claim 1.

The invention further relates to a resonator comprising such an inertia mobile component.

The invention further relates to a movement comprising such a resonator.

The invention further relates to a timepiece, in particular a watch, comprising such a movement.

The invention further relates to a method for reducing the sensitivity, to an external magnetic field, of a horological resonator comprising internal magnetic interaction means between at least one inertia mobile component of said resonator, mounted such that it pivots about an axis of oscillation and comprising magnetic elements, and an escape wheel set or a structural element that is magnetised and/or ferromagnetic, comprised in said resonator.

BRIEF DESCRIPTION OF THE DRAWINGS

Other features and advantages of the invention will be better understood upon reading the following detailed description given with reference to the accompanying drawings, in which:

in FIG. 7, two cylindrical magnets capable of rotating inside recesses, that are diametrically magnetised and have rotation axes parallel to the axis of oscillation of the inertia mobile component, and moments $\mu_{c1}$ and $\mu_{c2}$, that are rotated in order to adjust both the direction and intensity of the resultant thereof;

in FIG. 8, a radially-magnetised cylindrical magnet, the resultant magnetisation thereof is zero; the adjustment thus takes place by removing a part of this magnet;

in FIG. 9, micro-magnets (magnetic pixels) in the directions ±X and ±Y that are partially removed depending on the need;

in FIG. 10, a spherical magnet magnetised according to the axis of oscillation, which is in a spherical recess, allowing for the inclination thereof in order to create the component required for compensation;

DETAILED DESCRIPTION OF THE PREFERRED EMBODIMENTS

Figure 1:
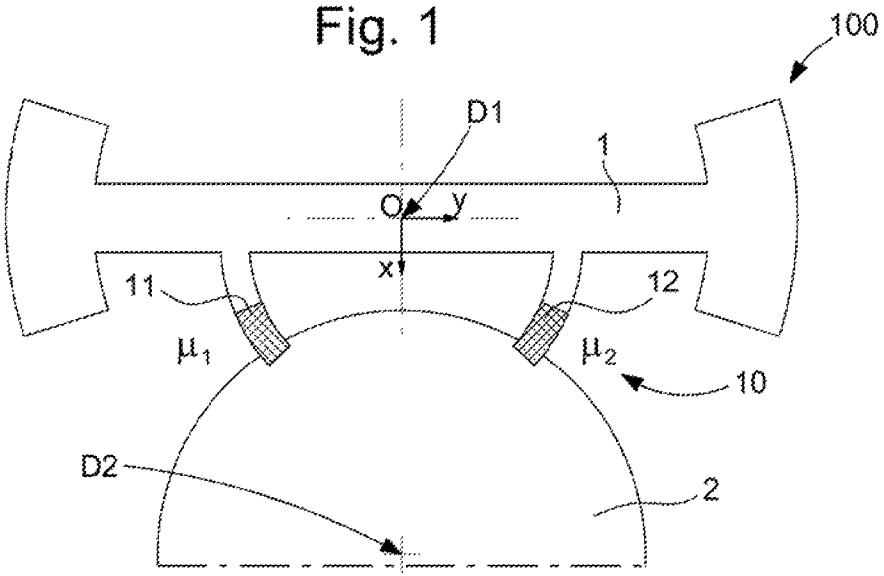
FIG. 1 diagrammatically shows a plan view of a part of a horological movement with an inertia mobile component of a resonator, at the top, the return means not being shown, comprising two magnetic pallet-stones arranged so as to engage with an escape wheel set comprised in an escapement mechanism of this movement; the inertia mobile component in this case is a balance, and the escape wheel set is an escape wheel.

The invention relates to the production of a horological mechanism that is insensitive to the external magnetic field, and more specifically a horological resonator of the magnetic type, or at least one part of the running thereof is based on magnetic attraction and/or repulsion, and in particular comprising magnets, which is insensitive to the external magnetic field.

The invention relates to a horological resonator 100. This horological resonator 100 comprises at least one inertia mobile component 1 arranged such that it oscillates about an axis of oscillation D1, and return means for maintaining the oscillation of this at least one inertia mobile component 1.

This at least one inertia mobile component 1 comprises at least one magnetic area 10, which is arranged so as to engage with an escape wheel set 2. This magnetic area 10 comprises at least one magnet or at least one magnetised ferromagnetic area.

Additionally, the total resultant magnetic moment of all of these magnetic areas 10 is aligned in the direction of the axis of oscillation D1.

According to the invention, from among all of said magnetic areas 10, a first set of magnetic areas 11, 12, 13, 14 is arranged for this magnetic interaction with the escape wheel set 2 or a structural element 3 of the resonator 100, such as a detent pin or similar element, and a second set of magnetic areas is arranged so as to compensate for the resultant of the magnetic moments of all of the magnetic areas of the first set, such that this resultant has a zero component in any plane perpendicular to the axis of oscillation D1.

Additionally, this second set comprises at least one magnetised area or at least one balancing magnet 6, the direction of the magnetic moment thereof crosses the axis of oscillation D1 in order to obtain magnetic balancing of this at least one inertia mobile component 1.

More particularly, the inertia mobile component 1 bears at least one magnetic compensating element 4, the magnetisation component thereof in a direction perpendicular to the axis of oscillation D1 can be adjusted in order to obtain a total resultant magnetic moment that is aligned in the direction of the axis of oscillation D1.

More particularly, the magnetic centre of mass of the inertia mobile component 1 is located on the axis of oscillation D1. This magnetic centre of mass is defined by the moments of order 1: $x_B$, $y_B$, $z_B$ of the component of the magnetic moment in the direction of the axis of oscillation D1.

$$x_B = \frac{\sum \mu_{i_z} x_i}{\sum \mu_{i_z}}$$

$$y_B = \frac{\sum \mu_{i_z} y_i}{\sum \mu_{i_z}}$$

$$z_B = \frac{\sum \mu_{i_z} z_i}{\sum \mu_{i_z}}$$

In these formulae, the sum is calculated for all infinitesimal elements of magnetic moment μi and only the component $\mu i_z$ along the axis of oscillation D1 is considered.

More particularly, all of the magnetic areas 10 comprised in this inertia mobile component 1 have permanent magnetisation.

Even more particularly, all of the magnetic areas 10 comprised in the inertia mobile component 1 only comprise permanent magnets, and are devoid of ferromagnetic components and of ferromagnetic areas, like the entirety of the inertia mobile component 1 is also devoid thereof.

The invention further relates to a horological resonator 100 comprising at least one such inertia mobile component 1, and comprising return means for maintaining the oscillation of the at least one inertia mobile component 1.

According to the invention, the resultant of the magnetic moments of all of the magnetic areas 10 borne by the at least one inertia mobile component 1 has a zero component in any plane perpendicular to the axis of oscillation D1.

More particularly, the resultant of the magnetic moments of all of the magnetic areas 10 borne by all of the inertia mobile components 1 of the same axis of oscillation D1, comprised in the resonator 100, has a zero component in any plane perpendicular to the axis of oscillation D1.

More particularly, all of the areas comprised in the resonator 100 in the immediate vicinity of the at least one inertia mobile component 1 have a zero magnetic moment, and are devoid of any ferromagnetic components, ferromagnetic areas and magnets.

More particularly, all of the areas comprised in the resonator 100 in the immediate vicinity of each inertia mobile component 1 of the same axis of oscillation D1, comprised in the resonator 100, have a zero magnetic moment, and are devoid of any ferromagnetic components, ferromagnetic areas and magnets.

The invention further relates to a horological movement 1000, comprising such a resonator 100, powering and/or energy storage means 300 arranged so as to power at least one such resonator 100, comprised in the movement 1000, and an escapement mechanism 200 comprising at least one escape wheel set 2 arranged so as to engage, with interaction, with the at least one inertia mobile component 1 of the resonator 100.

According to the invention, the at least one inertia mobile component 1 and the at least one escape wheel set 2 with which it engages, on the one hand comprise magnets which are permanent magnets, and on the other hand are devoid of ferromagnetic components and of ferromagnetic areas, like the entirety of the resonator 100 and the components of the escapement mechanism 200, other than the at least one escape wheel set 2 which comprises escapement magnets 299, which are also devoid thereof.

More particularly, the at least one inertia mobile component 1 is arranged such that it engages, with magnetic interaction, in a plane perpendicular to the axis of oscillation D1 or oblique relative to the axis of oscillation D1, with the at least one escape wheel set 2 and/or a structural element 3, that is magnetised and/or ferromagnetic, comprised in the movement 1000.

And the resultant of the magnetic moments of all of the magnetic areas 10 borne by the at least one inertia mobile component 1 has a zero component in any plane perpendicular to the axis of oscillation D1.

More particularly, the resultant of the magnetic moments of all of the magnetic areas 10 borne by all of the inertia mobile components 1 of the same axis of oscillation D1, comprised in the resonator 100, has a zero component in any plane perpendicular to the axis of oscillation D1.

More particularly, from among all of the magnetic areas 10 comprised in the at least one inertia mobile component 1, a first set of magnetic areas is arranged for the magnetic interaction with at least one escape wheel set 2 or a structural element 3, and a second set of magnetic areas is arranged so as to compensate for the resultant of the magnetic moments of all of the magnetic areas of the first set such that the resultant has a zero component in any plane perpendicular to the axis of oscillation D1, and the second set of magnetic areas is further arranged such that the magnetic interaction efforts of the constituents thereof with any escape wheel set 2 or any structural element 3 of the resonator 100 are less than one tenth of the magnetic interaction efforts of the constituents of the first set of magnetic areas with any escape wheel set 2 or any structural element 3 of the resonator 100.

More particularly, at least one escape wheel set 2 or at least one structural element 3 that is magnetised and/or ferromagnetic, comprised in the movement 1000, and which is arranged so as to engage, with magnetic interaction, with at least one inertia mobile component 1, has a resultant of the magnetic moments of all of the magnetised areas and of all of the magnets comprised therein having a zero component in any plane perpendicular to the axis of oscillation D1 or in any plane perpendicular to its own axis of oscillation if rotatably mounted.

More particularly, each escape wheel set 2 or structural element 3 that is magnetised and/or ferromagnetic, comprised in the movement 1000, and which is arranged so as to engage, with magnetic interaction, with at least one inertia mobile component 1, has a resultant of the magnetic moments of all of the magnetised areas and of all of the magnets comprised therein having a zero component in any plane perpendicular to the axis of oscillation D1 or in any plane perpendicular to its own axis of oscillation if rotatably mounted.

More particularly, the second set comprises at least one magnetised balancing area and/or a balancing magnet 6, the position of the magnetic centre of mass thereof, as defined hereinabove, is not located on the axis of oscillation D1, and is adjusted by calculation in order to obtain magnetic balancing of the at least one inertia mobile component 1.

More particularly, each magnetised area or magnet comprised in the second set has a magnetic moment, the position of the magnetic centre of mass thereof is not located on the axis of oscillation D1.

More particularly, the first set comprises at least one magnetised balancing area or a balancing magnet 6, the position of the magnetic centre of mass thereof is not located on the axis of oscillation D1 in order to obtain magnetic balancing of the at least one inertia mobile component 1.

More particularly, each magnetised area or magnet comprised in the first set has a magnetic moment, the position of the magnetic centre of mass thereof is not located on the axis of oscillation D1.

More particularly, the second set comprises at least one magnetised balancing area and/or a balancing magnet 6, the direction of the magnetic moment thereof crosses the axis of oscillation D1 in order to obtain magnetic balancing of the at least one inertia mobile component 1.

More particularly, each magnetised area or magnet comprised in the second set has a magnetic moment, the direction thereof crosses the axis of oscillation D1.

More particularly, the first set comprises at least one magnetised balancing area or a balancing magnet 6, the direction of the magnetic moment thereof crosses the axis of oscillation D1 in order to obtain magnetic balancing of the at least one inertia mobile component 1.

More particularly, the second set comprises at least one magnetised area or a balancing magnet 6, the position of the magnetic centre of mass thereof is located, relative to the axis of oscillation D1, opposite the magnetic centre of mass of the other magnets carried by the inertia mobile component, in order to obtain magnetic balancing of the at least one inertia mobile component 1.

More particularly, each magnetised area or magnet comprised in the first set has a magnetic moment, the direction of the magnetic moment thereof crosses the axis of oscillation D1.

More particularly, all of the magnetised areas and all of the magnets borne by each inertia mobile component 1 have permanent magnetisation.

More particularly, all of the magnetised areas and all of the magnets borne by at least one escape wheel set 2 or structural element 3, comprised in the movement 1000, have permanent magnetisation.

More particularly, all of the magnetised areas and all of the magnets borne by each escape wheel set 2 or structural element 3, comprised in the movement 1000, have permanent magnetisation.

More particularly, all of the magnetic areas 10, and each at least one magnetised area or each at least one balancing magnet 6, comprised in the inertia mobile component 1, have permanent magnetisation.

More particularly, this at least one inertia mobile component 1 and this at least one escape wheel set 2 with which it engages, respectively comprise magnetic areas 10 and at least one magnetised area or a balancing magnet 6, and escapement magnets, all of which are formed by permanent magnets, and are, with the exception of the magnetic areas 10 of the at least one magnetised area or of the at least one balancing magnet 6, and of the escapement magnets 299, devoid of ferromagnetic components and of ferromagnetic areas, like the entirety of the resonator 100 and the components of the escapement mechanism 200 other than the at least one escape wheel set 2 and the inertia mobile component 1.

More particularly, the inertia mobile component 1 is devoid of any ferromagnetic components and ferromagnetic areas other than the magnetic areas 10 and than the at least one magnetised area or the at least one balancing magnet 6, which are all formed by permanent magnets.

More particularly, all of the magnetic areas 10, and each at least one magnetised area or balancing magnet 6, and each at least one magnetic compensating element 4, comprised in the inertia mobile component 1, have permanent magnetisation.

More particularly, the inertia mobile component 1 is devoid of any ferromagnetic components and ferromagnetic areas other than the magnetic areas 10, the at least one magnetised area or the at least one balancing magnet 6, and the at least one magnetic compensating element 4, which are all formed by permanent magnets.

More particularly, at least one inertia mobile component 1 is a balance, and at least one escape wheel set 2 is an escape wheel.

More particularly, the movement 1000 comprises at least one structural element 3, which is arranged so as to engage, with magnetic interaction, with the at least one inertia mobile component 1 at a magnetic area 13, 14 thereof, and this structural element 3 is in particular a detent pin 33 or a banking limiting the travel of the at least one inertia mobile component 1, or a similar element.

The invention further relates to a timepiece 2000, in particular a watch, comprising at least one such movement 1000 and/or one such resonator 100.

More particularly, this watch 2000 comprises a case with a magnetic shield in order to enclose each resonator 100 comprised in the watch 2000.

The invention allows for the implementation of a method for reducing the sensitivity, to an external magnetic field, of a horological resonator 100 comprising internal magnetic interaction means between, on the one hand, at least one inertia mobile component 1 of the resonator 100, mounted such that it pivots about an axis of oscillation D1 and comprising magnetic elements 10, and, on the other hand, an escape wheel set 2 or a structural element 3 that is magnetised and/or ferromagnetic, comprised in the resonator 100, for which resonator 100 two reference axes OX and OY orthogonal to one another and to the axis of oscillation D1 are defined.

According to the invention:

- the resonator 100 is operated under steady-state power supply conditions,
- the reference run state thereof is measured,
- a first uniform magnetic field is applied to the resonator along the OX axis,
- and a first rate difference Δmx in X is measured by comparison with this referencerun state,
- a second uniform magnetic field is applied to the resonator along the OY axis, the magnetic flux density thereof is the same as that of the first field along the OX axis,
- a second rate difference Δmy in Y is measured by comparison with this referencerun state,
- the components respectively $\mu_{cx}$ in X and $\mu_{cy}$ in Y of a compensating magnetic moment $\mu_c$ are calculated, as a function of the first rate difference Δmx and of the second rate difference Δmy, and at least one magnetic compensating element 4 is produced, comprising the compensating magnetic moment $\mu_c$, or a set 5 of magnetic compensating and balancing elements are produced, the resultant magnetic moment thereof is equal to the compensating magnetic moment $\mu_c$, and the inertia mobile component 1 is equipped with at least one such magnetic compensating element 4, or respectively with such a set 5 of magnetic compensating and balancing elements, in the appropriate position of geometrical orientation relative to OX, OY, and to the axis of oscillation D1, the at least one magnetic compensating element 4 being on the axis of oscillation D1 or in the immediate vicinity thereof, or respectively the set 5 of magnetic compensating and balancing elements comprising:

on the one hand at least one magnetic compensating element 4 on the axis of oscillation D1 or in the immediate vicinity thereof, and on the other hand a magnetic balancing element 6 positioned opposite, relative to the axis of oscillation D1, the resultant of the magnetic elements 10 of the inertia mobile component 1, and the magnetic balancing moment $\mu_e$ thereof is oriented towards the axis of oscillation D1.

The figures more particularly show, in a non-limiting manner, the application of the invention to a resonator 100 with an inertia mobile component 1 which is a balance.

Let's consider a balance 1, mounted such that it pivots about an axis of oscillation D1, and which bears magnets 11 and 12 intended to interact with an escape wheel 2, pivoting about an escapement axis D2, as shown in FIG. 1, where the magnets 11, 12 are magnetic pallet-stones intended to directly interact with the escape wheel 2. Each magnet 11, 12 has a magnetic moment.

Each magnet 11, 12 has a magnetic moment, which is an extensive vector quantity calculated as being the integral of the magnetisation over the entire volume of the magnet. The magnetic moment can be shown as the needle of a compass, which is subject to a torque when immersed in an external magnetic field.

In order to minimise the perturbation effect of an external magnetic field on the resonator 100, the total magnetic moment of the magnets 11, 12, borne by the balance 1, must be aligned in the direction of the axis of oscillation D1 of the balance 1, in this case denoted as the Z axis.

Ideally, the magnetic moment should solely be formed of the component p, that is aligned with the Z axis. The component of this moment which is perpendicular to the Z axis, i.e. $\mu_{xy}$, represents an error that should ideally be corrected.

Figure 2:
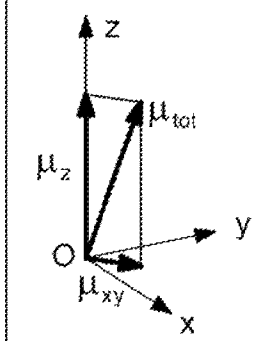
FIG. 2 is a graphical diagram showing the total resultant magnetic moment of the inertia mobile component in FIG. 1, with reference to a reference trihedron, the Z axis thereof is the axis of oscillation of the inertia mobile component. Ideally, the magnetic moment should solely be formed of the component that is aligned with the Z axis. The component perpendicular to the Z axis represents an error that should be corrected.

More specifically, let's suppose that the total resultant magnetic moment is not aligned with the Z axis, and thus that a component of the magnetic moment exists that is perpendicular to the axis of oscillation in FIG. 2. The total magnetic moment $\mu_{tot}$ is the sum of the magnetic moments of all of the magnets borne by the resonator; this total magnetic moment should be aligned with the axis of oscillation D1, the Z axis in the figure, in order to guarantee the insensitivity of the resonator to external fields. The vector $\mu_{tot}$ is the sum of a vector $\mu_{xy}$ representing the component of the total resultant moment in the plane XOY perpendicular to the Z axis, and of the component $\mu_z$ along this Z axis: to summarise, the component $\mu_{xy}$ is sought to be minimised and, where possible, cancelled out. This is because this component $\mu_{xy}$ of the total magnetic moment $\mu_{tot}$ will change direction when the balance 1 oscillates.

Figure 3:
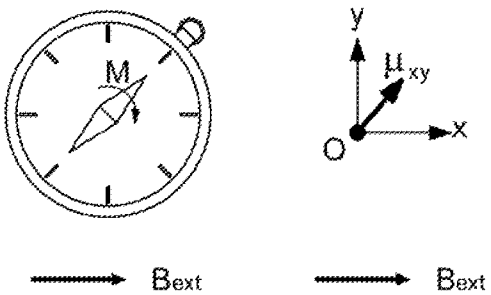
FIG. 3 diagrammatically shows the effect, compared to the needle of a compass, of the interference between this resultant magnetic moment of the inertia mobile component, and an external magnetic field Bext. The external magnetic field produces a perturbation torque on the inertia mobile component. This is a first perturbation effect that appears in an external magnetic field and that should ideally be cancelled out.

In the presence of an external magnetic field Bext, it is subjected to a torque which tends to align same with this external field, and the intensity thereof depends on the angular position of the balance 3, as shown in FIG. 3. The external magnetic field produces a perturbation torque on the inertia mobile component. This is a first perturbation effect that appears in an external magnetic field and that should ideally be cancelled out.

In theory, the magnetisation of the magnets 11, 12, borne by the balance 1, can still be assumed to be aligned in the direction of the axis of oscillation. However, in practice, it is known that there are always imperfections, resulting from the assembly, magnetisation, or other cause, and thus a small alignment error is unavoidable, and thus so is the presence of this small perturbation component $\mu_{xy}$.

More specifically, an alignment error produces such a small component $\mu_{xy}$ in the plane perpendicular to the axis of oscillation, which acts as a needle of a compass. Thus, an external magnetic field Bext produces a perturbation torque which depends on the position of the balance, and thus a variation of daily rate. More specifically, such a perturbation torque, which varies in a non-linear manner with the angle of the balance 1, is known to affect the running of the resonator 100.

The insensitivity of the resonator to external fields can be improved by several approaches.

Figure 4:
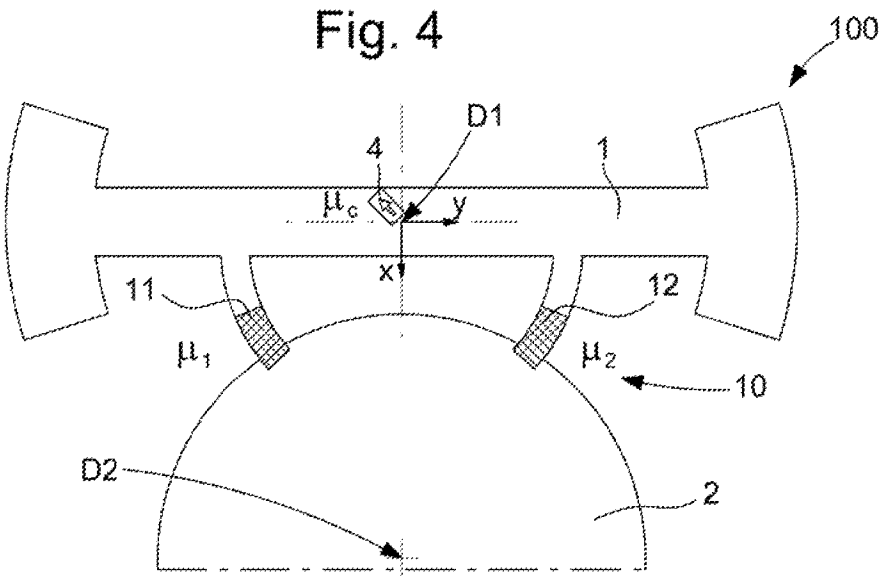
FIG. 4 shows, similarly to FIG. 1, the same mechanism improved by the addition of a magnetic compensating element, the magnetic moment component thereof in the XOY plane opposes the resultant of the magnetic moment of the two pallet-stones in this plane.
Figure 5:
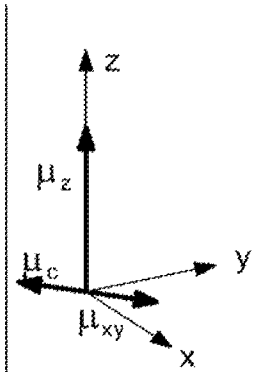
FIG. 5 is a graphical diagram similar to FIG. 2 showing the total resultant magnetic moment of the inertia mobile component in FIG. 4, brought to the Z axis thanks to the addition of the magnetic compensating element.
Figure 6:
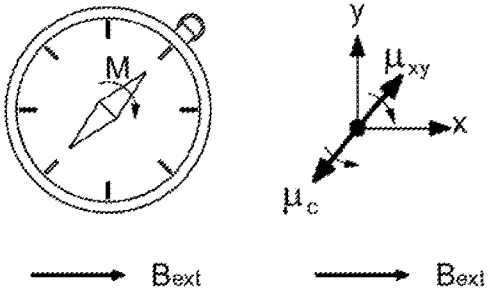
FIG. 6 is similar to FIG. 3 for the mechanism in FIG. 4.

The first improvement proposed thus consists of adding at least one compensating magnet 4 on the balance 1, as shown in FIG. 4. This is an additional magnet, which does not interact with the escape wheel 2, and the component $\mu_c$ thereof perpendicular to the axis of oscillation D1, is adjusted so as to have an equal intensity but a direction opposite to the component $\mu_{xy}$ (perpendicular to the axis of oscillation D1) of the other magnets borne by the balance 1, as shown in FIG. 5, so as to compensate for the effect of the magnetic moment $\mu_{xy}$. FIG. 5 shows that the total magnetic moment is thus reduced to $\mu_z$ and is thus aligned along OZ which corresponds to the axis of oscillation D1 of the balance 1. In this manner, as shown in FIG. 6, when the balance 1 is immersed in an external magnetic field Bext, the torque to which the compensating magnet 4 is subjected opposes the torque to which the other magnets 11, 12, carried by the balance 1, are subjected, to the extent of obtaining a total torque of zero. The perturbation torque is thus cancelled out.

There are several ways of producing such a compensating magnet 4, for which the component perpendicular to the axis of oscillation can be adjusted, as shown in FIGS. 7 to 10.

Figure 7:
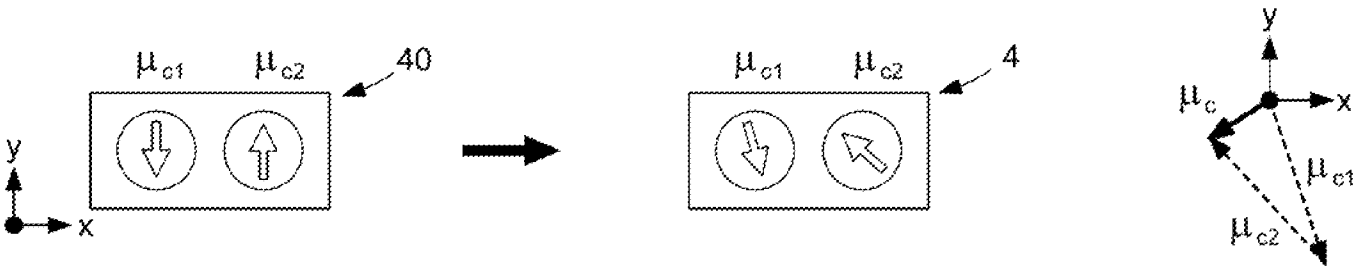
FIGS. 7 to 10 show several examples of magnetic compensating elements that are adjustable, with, in each instance, from left to right, the plan view of a prior state, then the plan view of the state after adjustments, then the magnetic moment diagram for obtaining a compensating magnetic moment in the desired direction.

Use of at least two diametrically-magnetised cylindrical magnets can be considered, the axis thereof is parallel to the axis of oscillation D1 of the resonator, having moments $\mu_{c1}$ and $\mu_{c2}$, which are rotated in order to adjust the resultant thereof, as shown in FIG. 7, both in terms of direction and intensity.

Figure 8:
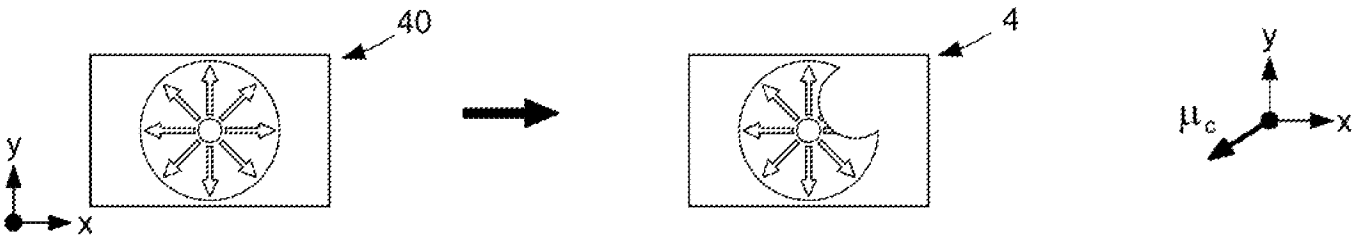

A radially-magnetised cylindrical magnet can also be added, the resultant magnetisation thereof is zero. The adjustment thus takes place by removing a part of this magnet, as shown in FIG. 8.

Figure 9:
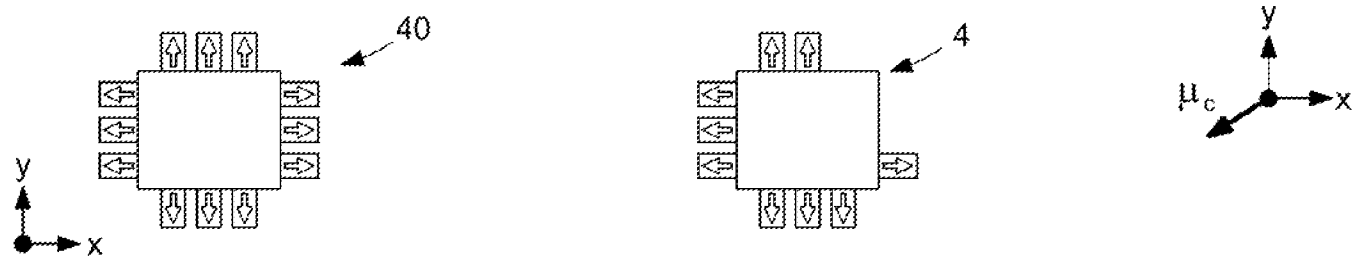

Micro-magnets (magnetic pixels) can also be considered in the directions ±X and ±Y that are removed as necessary, as shown in FIG. 9.

Figure 10:
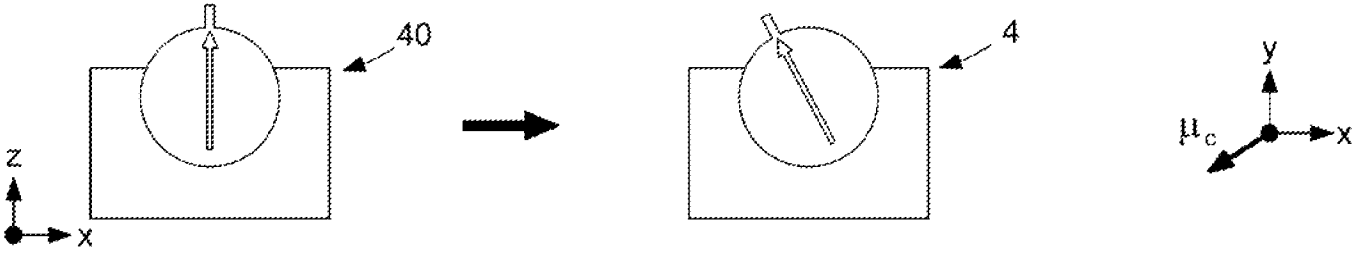

A spherical magnet magnetised along the axis of oscillation can also be considered, which magnet is located in a spherical recess, as shown in FIG. 10, in order to be able to incline same so as to create the component $\mu_c$ which is required for compensation. It goes without saying that any other mechanical means for adjusting the direction of the magnet can be used.

This list is non-exhaustive. For example, another solution would be to add a single cylindrical magnet, diametrically magnetised with the right intensity, equal to that of $\mu_{xy}$, and which could be oriented in order to adjust the direction of $\mu_c$. In order to adjust the intensity of this magnet, the field used for the magnetisation thereof can be varied.

Figure 11:
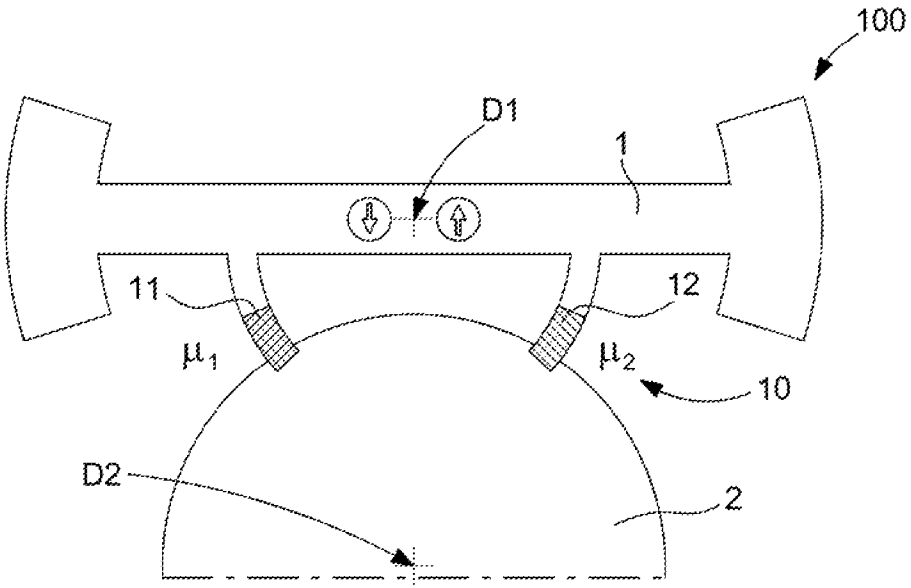
FIG. 11 shows, similarly to FIG. 4, the same mechanism improved by the addition of the cylindrical compensating magnets in FIG. 7, as close as possible to the axis of oscillation.

It goes without saying that each of these solutions for creating an adjustable compensating magnet is, advantageously, carried by the balance 1, close to the axis of oscillation D1 thereof, as shown in FIG. 11, which takes on the configuration shown in FIG. 7.

Regardless of the method used for the adjustment, the residual sensitivity of the resonator must be previously measured, and the desired compensation must be calculated. To achieve this, a uniform external magnetic field $B_{x0}$ is simply applied along +X and −X, and the rate difference $\Delta m_x$ resulting therefrom is measured. The same is carried out for a magnetic field along Y. The components of the compensating magnetic moment are calculated as follows: $\mu_x = k \cdot \Delta m_x / (86400\ B_{x0})$, and for the other component, simply replace x by y in this formula, where:

$\mu_x$=magnetic moment in $A \cdot m^{-2}$ k=rotational stiffness of the return spring of the balance in N*m/rad=N*m. For example $k=10^{-6}$ N·m/rad for a sprung balance.

$\Delta m_x$=rate in seconds per day $B_{x0}$=magnetic field in Tesla.

Figure 13:
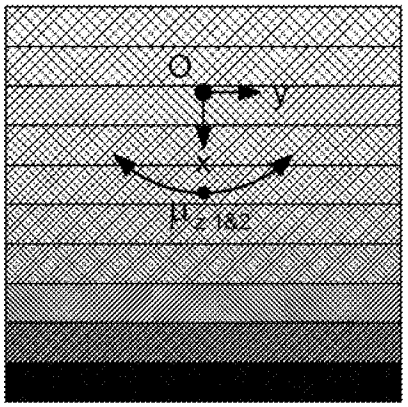
FIG. 13 is a diagrammatic representation of the displacement of the resultant magnetic moment of the two pallet-stones, during the oscillation of the inertia mobile component, in an external magnetic field Bz, which comprises an intensity gradient in the X direction, symbolised by greyed out areas of increasing density; this figure highlights a second perturbation effect, which only appears in the presence of a non-homogeneous external magnetic field, and that should ideally be corrected.

Let's now assume that this total magnetic moment alignment work has been carried out so that the component of the magnetic moment perpendicular to the axis of oscillation D1 has become negligible. The next perturbation effect that affects the running of the balance 1, when it is placed in an external field Bext is caused by the displacement, in an arc of a circle, of the magnetic moment in a non-homogeneous field $B_z$, as shown in FIG. 13. More specifically, the magnetic interaction energy varies in a non-linear manner with the position of the balance 1 to the extent of creating a perturbation torque which affects the running of the resonator 100.

Figure 12:
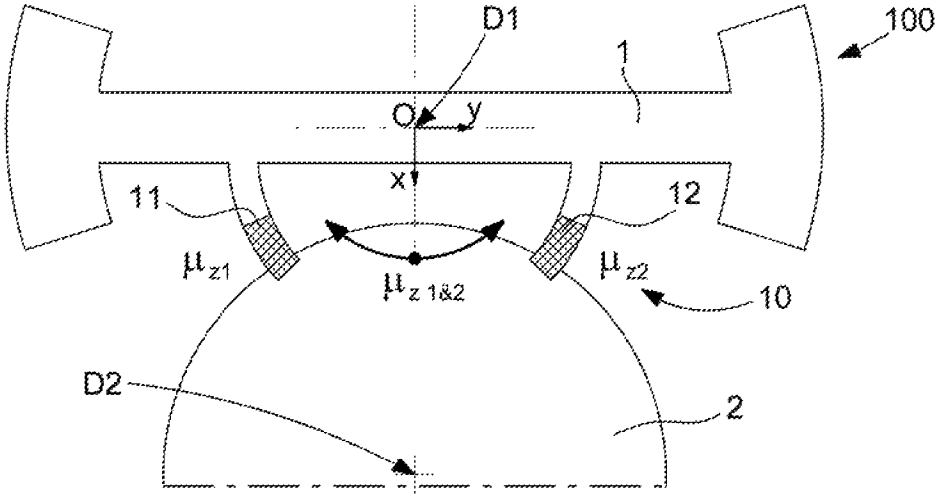
FIG. 12 shows, similarly to FIG. 4, a similar mechanism, the pallet-stones thereof have magnetic moments parallel to the axis of oscillation; in this case, the alignment error of the resultant magnetic moment relative to the axis of oscillation of the inertia mobile component is assumed to have already been corrected.

FIG. 12 shows a balance 1 with magnetic pallet-stones 11 and 12 which are magnetised along the OZ axis, with a resultant magnetic moment $\mu_{z1\&2}$ which is positioned at the magnetic centre of mass of the pallet-stones 11 and 12 (in comparison with the total mass of a wheel set positioned at the centre of mass thereof). FIG. 13 shows the displacement of the same resultant magnetic moment in a non-homogeneous magnetic field $B_z$, illustrated in this case with a field intensity gradient along X, shown by increasingly greyed over areas. The magnetic interaction energy varies in a non-linear manner with the position of the balance 1 in this field.

In order to cancel out this effect, it suffices to position the resultant magnetic moment on the axis of oscillation D1 (point O). However, the magnetic pallet-stones 11 and 12 that interact with the escape wheel 2 cannot be displaced to this point.

Figure 14:
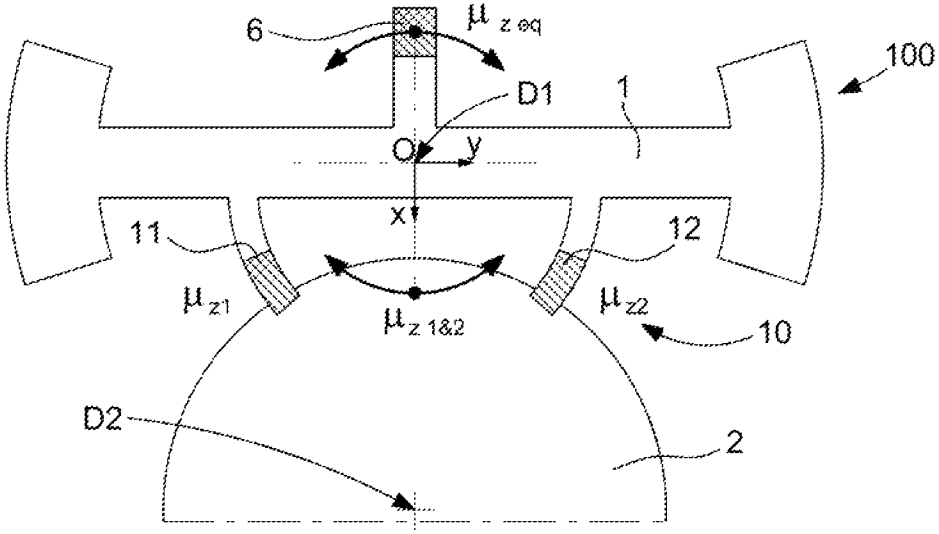
FIG. 14 shows, similarly to FIG. 12, the same mechanism improved by the addition of a balancing magnet, further comprising a magnetic moment parallel to the axis of oscillation, and mounted on the opposite side of the pallet-stones relative to the axis of oscillation; the purpose of the balancing magnet is to eliminate the second perturbation effect.
Figure 18:
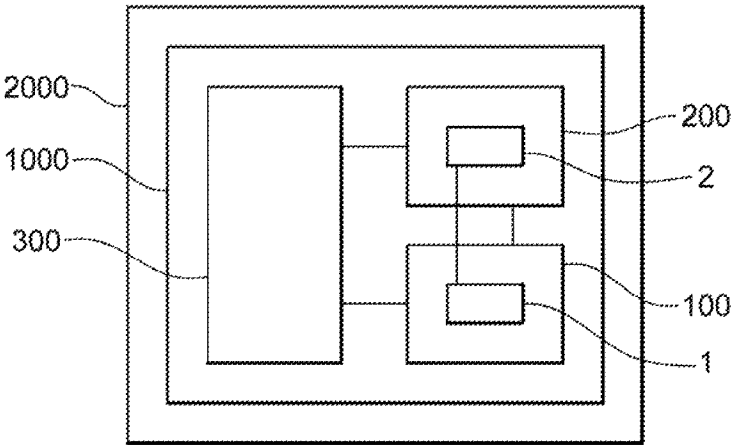
FIG. 18 is a block diagram showing a timepiece, in particular a watch, comprising a movement, comprising powering and/or energy storage means arranged so as to power at least one such resonator, and an escapement mechanism comprising at least one escape wheel set arranged so as to engage, with interaction, with such an inertia mobile component.
Figure 16:
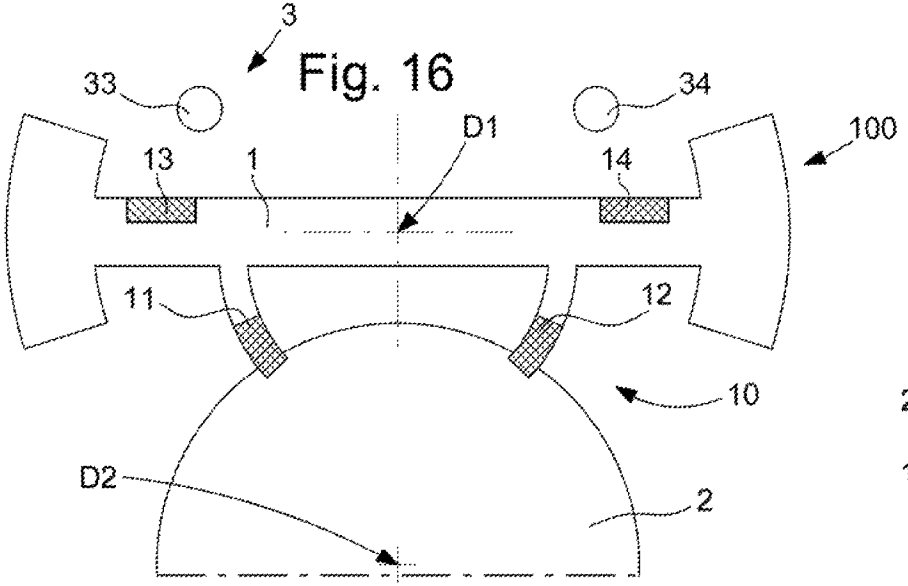
FIG. 16 shows, similarly to FIG. 1, a similar mechanism, with a magnetic interaction between elements of a fixed structure of the horological movement, such as detent pins, bankings or similar elements, and magnetic areas of the inertia mobile component, in this case shown opposite the pallet-stones relative to the axis of oscillation.
Figure 17:
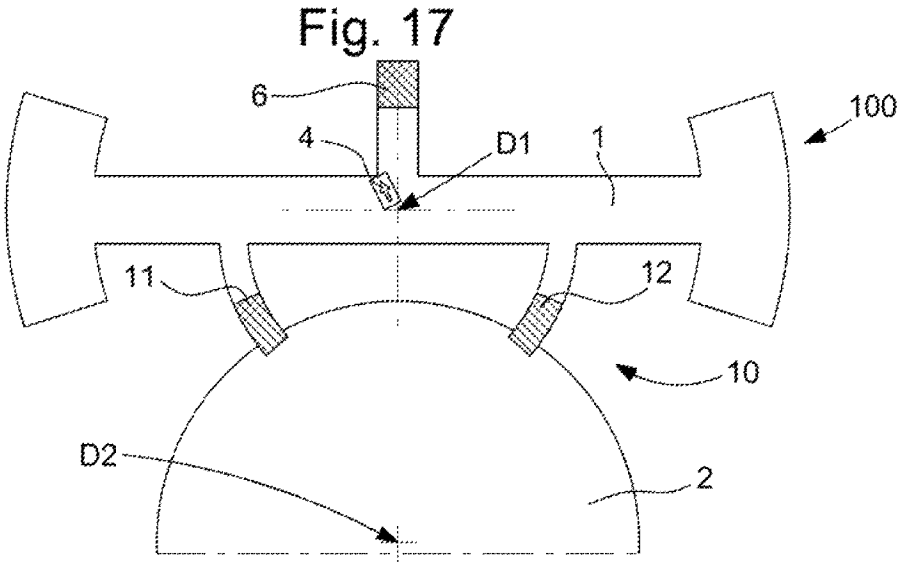
FIG. 17 shows, similarly to FIGS. 4 and 14, a similar mechanism, which comprises both a compensating magnet and a balancing magnet.

A second improvement proposed thus consists of adding a balancing magnet 6, as shown in FIG. 14. This balancing magnet 6 is located opposite the escape wheel 2, relative to the axis of oscillation D1, and far enough away from this escape wheel 2 so as not to interact therewith.

This balancing magnet 6 is magnetised in the direction of the axis of oscillation D1. It is positioned opposite the position of the magnetic centre of mass of the other magnets 11 and 12 carried by the balance 1, as shown in FIG. 14. In this manner, the trajectory taken by the magnetic moment of the balancing magnet 6 in the external field $B_z$ produces, in the first order, a perturbation torque that opposes that which is applied to the other magnets 11 and 12 carried by the balance 1. Another way to explain the role of this magnet is to discuss magnetic balancing. The purpose is to bring that which is known as a magnetic centre of mass of the magnetic moment onto the axis of oscillation D1. This magnetic centre of mass is defined by the moments of order 1 ($x_B$, $y_B$, $z_B$) of the component of the total resultant magnetic moment that is in the direction of the axis of oscillation D1.

In other words, the mass is replaced by μz in the definition of the centre of mass:

$$x_B = \frac{\sum \mu_{i_z} x_i}{\sum \mu_{i_z}}$$

$$y_B = \frac{\sum \mu_{i_z} y_i}{\sum \mu_{i_z}}$$

$$z_B = \frac{\sum \mu_{i_z} z_i}{\sum \mu_{i_z}}$$

More specifically, in order to obtain magnetic balancing, the magnetic centre of mass of the total magnetisation of the resonator 100 is placed on the axis of oscillation D1.

Figure 15:
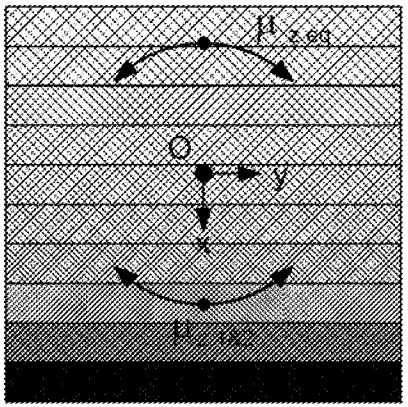
FIG. 15 is a diagrammatic representation, similar to FIG. 13, of the displacement of the resultant magnetic moment of the two pallet-stones and of that of the balancing magnet in FIG. 14, in the same external field. The interaction energy variation resulting from the displacement of the balancing magnet in the external field cancels out that resulting from the displacement of the two pallet-stones.

This approach is applicable to the example shown in FIGS. 13 and 15 (which shows, similarly to FIG. 13, the displacement of the magnetic moments of the pallet-stones 11 and 12, in addition to that of the balancing magnet 6 in the external field), where a relatively steady external field gradient exists, in this case along X in this example. However, this approach is not valid if the external field varies with significant non-linearity. In principle, such significant non-linearity is not produced if there are no ferromagnetic elements in the vicinity of the balance 1. Thus, in practice, the ferromagnetic components must be moved far enough away from the balance 1 for this method to be effective.

A plurality of methods are available for adding this magnetic balancing magnet. It should be specified that the geometrical configuration and location of this balancing magnet can be calculated when designing the pallet-stone magnets 11, 12 and similar elements. Thus, the balancing magnet 6 can be manufactured with the same technology used to manufacture the pallet-stones: conventional machining, laser, thin film deposition, or other technology. Another solution can consist of subsequently adding same, for example, by spraying magnetic material onto the balance felloe, by additive manufacturing or jetting, or by any other suitable method, in order to balance it. It goes without saying that this list is not exhaustive.

To summarise, the invention proposes:

an inertial mass of a resonator, in particular an oscillating balance, which bears magnets all of which are aligned in the direction of the axis of oscillation of this inertial mass;

such an inertial mass to which a small compensating magnet is added, which has a magnetisation component in the direction perpendicular to the axis of oscillation; this compensating magnet must be adjusted in order to obtain a total magnetic moment that is aligned in the direction of the axis of oscillation;

such an inertial mass, with or without a compensating magnet, to which a small balancing magnet is added, which is magnetised in the direction of the axis of oscillation; this balancing magnet must be sized and positioned so as to bring the magnetic centre of mass onto the axis of oscillation;

an alternative with an inertial mass according to one of these embodiments, and from which all of the ferromagnetic components have been removed, or which, by design, is devoid of any ferromagnetic area;

a horological movement with a resonator comprising at least one inertial mass according to one of the embodiments hereinabove, and in the vicinity thereof all of the magnetic and/or ferromagnetic components have been removed, with the exception of the magnets of the escape wheel set, in particular an escape wheel, engaging with this inertial mass.

The invention allows high insensitivity to be obtained for a resonator incorporating magnetic functions into the external magnetic fields, without any noteworthy increase in the volume of the components thereof, and at a low cost.

The invention applies equally to new equipment as it does to mechanisms that have already been manufactured, which can be safely improved under reasonable economic conditions.

The invention is described herein with reference to the specific case of a resonator, which is the most sensitive member of a timepiece, for which any magnetic perturbation is capable of having direct repercussions by degrading the running thereof. The horologist will also know how to apply this to other less sensitive mechanisms of a watch, such as magnetic strike mechanisms or other mechanisms.

The invention has been described with reference to the preferred case of a magnetic interaction, however the principle remains applicable to an electrostatic interaction, or even to a combined magnetic and electrostatic interaction.

The invention claimed is:

1. A horological resonator comprising:

an inertia mobile component configured to oscillates about an axis of oscillation; and return means configured to maintain oscillation of the inertia mobile component, wherein the inertia mobile component comprises magnetic areas, and a total resultant magnetic moment of all of the magnetic areas is aligned in the direction of the axis of oscillation, wherein a first set of magnetic areas, from among the magnetic areas, is configured for magnetic interaction with an escape wheel set or a structural element, that is separate from the inertia mobile component, of the horological resonator, wherein a second set of magnetic areas, from among the magnetic areas, is configured to compensate for a resultant of magnetic moments of all of the first set of magnetic areas, such that the total resultant magnetic moment of all of the magnetic areas has a zero component in any plane perpendicular to the axis of oscillation, and wherein a direction of a magnetic moment of the second set of magnetic areas crosses the axis of oscillation such that magnetic balancing of the inertia mobile component is obtained.

2. The horological resonator according to claim 1, wherein the second set of magnetic areas is further configured such that magnetic interaction efforts of the second set of magnetic areas with the escape wheel set or the structural element are less than one tenth of magnetic interaction efforts of the first set of magnetic areas with the escape wheel set or the structural element.

3. The horological resonator according to claim 1, wherein a magnetic center of mass of the inertia mobile component is located on the axis of oscillation, the magnetic center of mass being defined by moments of order 1 of a component, of the total resultant magnetic moment of all of the magnetic areas, that is in the direction of the axis of oscillation.

4. The horological resonator according to claim 1, wherein all of the magnetic areas have permanent magnetization.

5. The horological resonator according to claim 4, wherein the inertia mobile component is devoid of any ferromagnetic components and ferromagnetic areas other than the magnetic areas, which are all formed by permanent magnets.

6. The horological resonator according to claim 1, wherein the inertia mobile component comprises at least one magnetic compensating element that comprises a magnetization component that is in a direction perpendicular to the axis of oscillation and configured to be adjusted in order to adjust the total resultant magnetic moment to be aligned in the direction of the axis of oscillation.

7. The horological resonator according to claim 6, wherein each of the magnetic areas and each of the at least one magnetic compensating element have permanent magnetization.

8. The horological resonator according to claim 7, wherein the inertia mobile component is devoid of any ferromagnetic components and ferromagnetic areas other than the magnetic areas and the at least one magnetic compensating element, which are all formed by permanent magnets.

9. A horological movement comprising:

the horological resonator according to claim 1; and an escapement mechanism comprising:

the escape wheel set, the escape wheel set configured to magnetically engage with at least one from among the first set of magnetic areas of the inertia mobile component; and a powering and/or energy storage means configured to power the horological.

10. The horological movement according to claim 9, wherein the escape wheel set comprises escapement magnets, and all of the magnetic areas and the escapement magnets are formed by permanent magnets, and are, with the exception of any magnetic area from among the second set of magnetic areas, devoid of ferromagnetic components and of ferromagnetic areas.

11. The horological movement according to claim 10, wherein the first set of magnetic areas of the inertia mobile component are configured to magnetically engage, in a plane perpendicular to the axis of oscillation or oblique relative to the axis of oscillation, with the escape wheel set and/or the structural element, that is magnetized and/or ferromagnetic.

12. The horological movement according to claim 9, wherein the escape wheel set has a resultant of magnetic moments, of all magnetic areas comprised therein, having a zero component in any plane perpendicular to the axis of oscillation of the inertia mobile component or in any plane perpendicular to an axis of oscillation of the escape wheel set, or the structural element has a resultant of magnetic moments, of all magnetic areas comprised therein, having a zero component in any plane perpendicular to the axis of oscillation of the inertia mobile component or in any plane perpendicular to an axis of oscillation of the structural element if rotatably mounted.

13. The horological movement according to claim 9, wherein the escape wheel set has a resultant of magnetic moments, of all magnetic areas comprised therein, having a zero component in any plane perpendicular to the axis of oscillation of the inertia mobile component or in any plane perpendicular to an axis of oscillation of the escape wheel set, and the structural element has a resultant of magnetic moments, of all magnetic areas comprised therein, having a zero component in any plane perpendicular to the axis of oscillation of the inertia mobile component or in any plane perpendicular to an axis of oscillation of the structural element if rotatably mounted.

14. The horological movement according to claim 9, wherein a position of the magnetic center of mass of the second set of magnetic areas is located, relative to the axis of oscillation, opposite a magnetic center of mass of other magnets of the inertia mobile component, in order to obtain magnetic balancing of the inertia mobile component.

15. The horological movement according to claim 9, wherein each magnetic the second set of magnetic areas has a magnetic moment, the direction of the magnetic moment of the each magnetic area of the second set of magnetic areas crosses the axis of oscillation.

16. The horological movement according to claim 9, the direction of the magnetic moment of the first set of magnetic areas crosses the axis of oscillation such that magnetic balancing of the inertia mobile component is obtained.

17. The horological movement according to claim 16, wherein each magnetic area of the first set of magnetic areas has a magnetic moment, the direction of the magnetic moment of each of the each magnetic area of the first set of magnetic areas crosses the axis of oscillation.

18. The horological movement according to claim 9, wherein all magnetic area of the inertia mobile component have permanent magnetization.

19. The horological movement according to claim 9, wherein all magnetic areas of the escape wheel set or the structural element have permanent magnetization.

20. The horological movement according to claim 19, wherein all magnetic areas of the escape wheel set or the structural element have permanent magnetization.

21. The horological movement according to claim 9, wherein the inertia mobile component is a balance, and the escape wheel set comprises an escape wheel.

22. The horological movement according to claim 9, wherein the horological movement comprises at least one said structural element, which is arranged so as to engage, with magnetic interaction, with the inertia mobile component, and which is a detent pin or a banking limiting travel of the inertia mobile component.

23. A watch comprising the horological movement according to claim 9.

24. A watch according to claim 23, wherein the watch comprises a case with a magnetic shield that encloses the horological resonator comprised in the watch.

* * * * *